US008828161B1

(12) United States Patent
Stiles et al.

(10) Patent No.: US 8,828,161 B1
(45) Date of Patent: Sep. 9, 2014

(54) BALLISTIC MODIFICATION AND SOLVENTLESS DOUBLE BASE PROPELLANT, AND PROCESS THEREOF

(75) Inventors: Stephen N. Stiles, Port Tobacco, MD (US); Paul R. McCool, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 3218 days.

(21) Appl. No.: 11/345,682

(22) Filed: Jan. 30, 2006

(51) Int. Cl.
*C06B 23/00* (2006.01)

(52) U.S. Cl.
USPC ... 149/19.8; 149/19.93; 149/19.7; 149/19.92; 149/110

(58) Field of Classification Search
USPC ..... 149/19.8, 19.93, 19.7, 19.92, 110
See application file for complete search history.

(56) References Cited

U.S. PATENT DOCUMENTS

| | | | | |
|---|---|---|---|---|
| 3,951,704 A | | 4/1976 | Stack | 149/19.8 |
| 3,954,667 A | | 5/1976 | Stack | 556/28 |
| 4,080,411 A | | 3/1978 | Stanley | 264/3.4 |
| 4,082,584 A | | 4/1978 | Satriana et al. | 149/109.4 |
| 4,521,261 A | * | 6/1985 | Davies | 149/82 |
| 4,689,097 A | | 8/1987 | Jones | 149/21 |
| 4,758,287 A | | 7/1988 | Pietz | 142/2 |
| 4,889,706 A | | 12/1989 | Uedaira et al. | 423/594.9 |
| 5,254,186 A | | 10/1993 | Downes et al. | 149/19.4 |
| 5,385,619 A | | 1/1995 | Downes et al. | 149/19.4 |
| 5,472,647 A | | 12/1995 | Blau et al. | 264/3.1 |
| 5,489,349 A | | 2/1996 | Headley | 149/35 |
| 5,492,681 A | | 2/1996 | Pasek et al. | 423/32 |
| 5,500,059 A | | 3/1996 | Lund et al. | 149/19.1 |
| 5,501,823 A | | 3/1996 | Lund et al. | 264/3.1 |
| 5,639,987 A | | 6/1997 | Berteleau et al. | 149/19.8 |
| 5,652,409 A | | 7/1997 | Thompson et al. | 149/98 |
| 6,024,810 A | | 2/2000 | Neidert et al. | 149/19.8 |

FOREIGN PATENT DOCUMENTS

GB 2121399 * 12/1983

OTHER PUBLICATIONS

"NSWCIHD-AA-16 and NSWCIHD-AA-17 Extuded Double Base (EDB) Process Development and Performance of Ballisic Modifiers," S.N. Stiles and P.R. McCool, Mar. 25-28, 2003, VA.
"NSWCIHD-AA-16 and NSWCIHD-AA-17 Extuded Double Base (EDB) Process Development and Performance of Ballisic Modifiers," S.N. Stiles and P.R. McCool, Presentation; 2003, VA.
Department of Defense Directive, No. 5230.24, "Distribution Statements on Technical Documents," Mar. 18, 1987.
Department of Defense,"Distribution Statements on Technical Documents-Extracts from DOD Directives 5230.24," printed on Jan. 18, 2006.
Wu,Mingmei, et al. Hydrothermal Synthesis of Pb2SN04, Materials Research Bulletin, vol. 34, No. 7,pp. 1135-1142, 1999.
Sugawara, F., Syono, Y., Akinoto, S., High Pressure Synthesis of a New Perovskite PbSn03, MAterials Research Bulletin, vol. 3, pp. 529-532, 1968.
Chandler, C.D., Musser, D.A., Langford, T.H., Krajowski, E.A., Reduction of Rolled Power Fires, pp. 361-370, Jul. 1991.
U.S. Appl. No. 11/342,941, filed Jan. 30, 2006, Stiles, et al.

* cited by examiner

*Primary Examiner* — Carol M Koslow
(74) *Attorney, Agent, or Firm* — Fredric J. Zimmerman

(57) ABSTRACT

A double base propellant modifier uses a lead-tin component with a defined amount of lead and a copper component with a defined surface area to effect super-rate burning of double base propellants with defined plateau and mesa burning rate characteristics.

16 Claims, 7 Drawing Sheets

BALLISTIC MODIFICATION AND SOLVENTLESS DOUBLE BASE PROPELLANT, AND PROCESS THEREOF

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

FIELD OF THE INVENTION

Modifier formulations are used to effect super-rate burning of double base propellants with defined plateau and mesa burning rate characteristics.

BACKGROUND

Ballistic modifiers for double base propellants are used to modify burning characteristics of double base propellants. A double base propellant generally contains an energetic polymer, such as nitrocellulose, plasticized into a gel by an energetic plasticizer, such as nitroglycerine. Additives may be included in these double base propellants to improve the mechanical or ballistic properties of the propellant. One such additive is termed a ballistic modifier, which alters the inherently high dependence of the burning rate on chamber temperature and chamber pressure.

Ballistic modification allows the rocket motor to operate within a wider pressure range with only small changes in its burn rate, commonly referred to as a plateau. This phenomenon was first observed, accidentally, with the use of lead stearate, which was commonly used as an extrusion lubricant in solventless double-base propellants produced during World War II. The plateau is the result of a catalytic or super-rate effect on burn-rate that occurs at pressures well below the maximum burn-rate that is observed on unmodified propellant, thus producing burn rate curves with a slope approaching zero in the plateau region. When the slope of the burning rate curve becomes less than zero, the burning rate decreases with increasing pressure and results in what is termed a mesa. However, little has been known about the specific properties of the ballistic modifiers that affect propellant burning rates. The objective in ballistic modification of double base rocket propellants is to obtain plateau or mesa burning over a desired range of pressure and burning rate levels. These terms come from the shape of a log-log plot of the burning rate equation for double-base propellants which is given as: $r=CP^n$ or $\log r=n \log P+\log C$, where r is the burning rate, P is the combustion chamber pressure, C is a constant for each propellant composition at any one temperature, and n is a constant for non-modified propellants but is a variable in modified propellants. In plateau- or mesa-burning propellants, "n" varies from very high positive values to zero or low negative values. Thus, a plot of log r against log P would give a straight line with a slope of "n" for a non-modified propellant, but a "plateau" shaped line or a mesa-shaped line for modified propellants. The performance of a ballistic modifier is measured in terms of the rate increase and pressure extent of plateau burning. Super rate defines the concept of substantially increasing burn-rate at any given pressure over burn-rates obtained from non-modified propellants.

There is a need in the art for improvements in ballistic modifiers for double base propellants. The present invention addresses this need and other needs.

SUMMARY OF THE INVENTION

The present invention includes a double base propellant modifier including a lead-tin component having a defined lead content, and a copper component having a defined surface area. The present invention also includes a double base propellant that incorporates this double base propellant modifier.

Additionally, the present invention includes a process for defining burn rate characteristics of a double base propellant including the steps of providing a double base propellant modifier including, in combination, a lead-tin component and a copper component, controlling the lead content of the lead-tin component, controlling the surface area of the copper component, integrating the double base propellant modifier into a double base propellant and burning the double base propellant.

DETAILED DESCRIPTION OF THE DRAWINGS

DETAILED DESCRIPTION OF AN EMBODIMENT OF THE INVENTION

Figure 1:
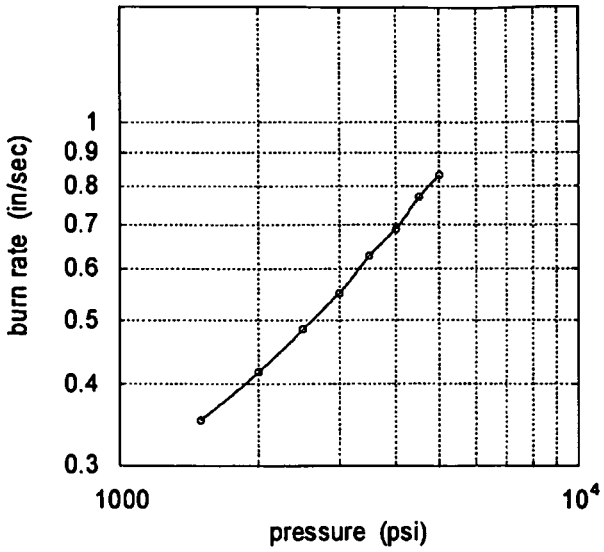
FIG. 1 illustrates a strand burn rate for an unmodified propellant.

The present invention includes modifier formulations used to effect super-rate burning of double base propellants with defined plateau and mesa burning rate characteristics. These modifiers are particularly useful in solid rocket propellants. The double base propellant modifier of the present invention includes a combination of lead and copper components. By controlling specific aspects of these two components, significant advantages are produced by the modifier compositions.

The double base propellant modifier of the present invention includes a combination of a lead-tin component having a defined lead content and a copper component having a defined surface area. The lead-tin component of the present invention is a single component, that is, a single molecule, including lead chemically combined with tin held together by chemical forces, that is, chemical bonds, where the lead may include lead of various oxidative states. Representative examples of the lead-tin component include PbSnO, $PbSnO_3$, $Pb_2SnO_4$, $Pb_3SnO_4$ and combinations thereof, and more particularly $PbSnO_3$ and $Pb_3SnO_4$. The lead-tin component includes a lead content from about 40 wt % to about 70 wt % of the mass of the lead-tin component, and more particularly a lead content from about 50 wt % to about 60 wt % of the mass of the lead-tin component, and even more particularly a lead content from about 52 wt % to about 57 wt % of the mass of the lead-tin component.

The copper component may include elemental copper or copper of various oxidative suites. Representative examples of the copper component include Cu, CuO, $Cu_2O$ and combinations thereof. In an embodiment, the copper component includes CuO. The CuO generally includes a surface area from about 20 $m^2/g$ to about 40 $m^2/g$, and more particularly from about 25 $m^2/g$ to about 35 $m^2/g$, and even more particularly about 30 $m^2/g$. The copper component modifier is generally present in amounts from about 1 wt % to about 3 wt %. Representative particle sizes for the copper component range from about 41-nanometers to about 30-microns. In an embodiment, the double base propellant modifier includes a lead-tin component including a lead content from about 52 wt % to about 57 wt % of the mass of the lead-tin component, and the copper component includes CuO having a surface area from about 25 $m^2/g$ to about 35 $m^2/g$. The lead-tin and copper components are milled to specified parameters to provide definitive plateau and mesa burning characteristics for a given double base propellant. Accordingly, various defined plateau and mesa burning characteristics may be achieved with modification of the particle size and/or amount of each of the individual modifier components.

Cupric oxide was found to be readily commercially available from numerous sources, because of a wide range of uses. The color of cupric oxide can either be black or brown and is directly related to its method of manufacture. The black cupric oxide has a lower specific surface area and higher apparent density compared to the brown cupric oxide. Commercially available material in a wide range of particle sizes and specific surface areas were used in a number of evaluations. An initial hypothesis that the smaller particle size diameter would provide the desired performance proved inaccurate. Lead stannate was not as readily available, as cupric oxide, given its limited commercial use and the variety of chemical forms, including PbSnO, $PbSnO_3$, $Pb_2SnO_4$, and $Pb_3SnO_4$. The ballistic modifiers used in the propellant evaluations were evaluated using particle size techniques, BET specific surface area measurements and elemental analysis. In conjunction with ballistic modification, propellant processing techniques also proved to be a significant factor in increasing propellant burning rates.

Synthesis of the ballistic modifiers may be performed by any appropriate methodologies for effectively pure forms of the lead and copper components. Generally, component purity of the lead component ranges from about 40% or greater, and more particularly from about 45% or greater, and most particularly from about 50% or greater. In an embodiment, component purity of the copper component ranges from about 70% or greater, and more particularly from about 75% or greater, and most particularly from about 80% or greater. One such representative synthesis includes preparation by reacting an aqueous solution of lead nitrate with an aqueous solution of sodium stannate (shown below in equation 1, described in Wu, Mingmei, et. al., Hydrothermal Synthesis of $Pb_2SnO_4$, Materials Research Bulletin, Vol. 34, No. 7, pp. 1135-1142, 1999, the disclosure of which is herein incorporated by reference) and collecting the precipitated product through a series of washings to remove sodium nitrate.

$$Pb(NO_3)_2+Na_2(SnO_3)\rightarrow PbSnO_3(s)+2NaNO_3 \quad (1)$$

Alternatively lead acetate or potassium stannate (shown below in equation 2) may be substituted into equation 1.

$$Pb(OOCCH_3)_2+K_2(SnO_3)\rightarrow PbSnO_3(s)+2KOOCCH_3 \quad (2)$$

Solutions are generally prepared using distilled or deionized water and stirred under heat to effect solubility. The solutions are filtered to remove insoluble matter, particularly when using sodium stannate because of its insoluble matter due to its high tin content. Generally when the solutions containing the reactants are combined, a very fine milky-white precipitate is formed. In an embodiment, the milky-white precipitate product includes at least a 57% lead content (effective for the desired burn rate for the propellant). Drying the product causes particles to form aggregates and changes its appearance to a pale yellow cake.

Additional techniques for preparing lead stannate are described in Sugawara, F., Syono, Y., Akimoto, S., High Pressure Synthesis of a New Perovskite $PbSnO_3$, Materials Research Bulletin, Vol. 3, pp-529-532, 1968, the disclosure of which is herein incorporated by reference. In Suugawara, sintering of lead oxide (PbO) and tin oxide ($SnO_2$) at pressures and temperatures of 60-kb to 70-kb (8.7E+5 psi) and 500° C. is performed. Significant disadvantages of this method include limitations in batch size and the physical form of the product. The product material is very hard and difficult to reduce in size complicating the synthesis of large quantities of lead using this method.

Representative synthesis of cupric oxide includes reacting aqueous solutions of copper nitrate and sodium carbonate (shown in equation 3, below) with vigorous stirring. The reaction proceeds with precipitation of the intermediate product copper carbonate.

$$Cu(NO_3)_2+Na_2CO_3\rightarrow CuCO_3+2NaNO_3 \quad (3)$$

Continued addition of sodium carbonate and heat (Δ) causes the green copper carbonate precipitate to change to cupric oxide (shown in equation 4, below).

$$CuCO_3+Na_2CO_3+\Delta\rightarrow CuO+CO_2 \quad (4)$$

Alternatively sodium hydroxide or potassium hydroxide may be substituted for sodium carbonate. The cupric oxide is filtered and washed to remove sodium carbonate and sodium nitrate. Generally, all solutions are prepared using distilled or deionized water and filtered to remove insoluble matter. Upon drying, the cupric oxide is a fine brown powder of relatively small particle size and high surface area. Alternate methods of producing cupric oxide produced a fine black powder with similar particle size, however resulting in much less surface area. These methods included heating, in a muffle furnace, commercially available copper carbonate or copper nitrate. Conversion of the copper nitrate occurs at its decomposition temperature with liberation of nitrogen dioxide. This method is not suggested in uses of the copper that require preparation of large quantities of the copper.

Propellants of the present invention may include energetic polymers and combinations of energetic polymers known in double base propellants, such as, plastic bonded explosives, such as, nitroguanidine, aromatic nitramines, such as, tetryl, ethylene dinitramine, nitrate esters, such as, nitroglycerine, butanetriol trinitrate, and PETN (pentaerythritol tetranitrate), other nitroaromatic compounds, such as, trinitrotoluene (TNT), triaminobenzene (TATB), triaminotrinitro benzene (TATNB), and hexanitrostilbene, nitroglycerine, nitrocellulose, etc., alicylclic nitramines, such as, RDX (1,3,5-cyclotrimethylene-2,4,6,-trinitramine), and HMX (1,3,5,7-cyclotetramethylene-2,4,6,8-tetranitramine), and TATND (tetranitro-tetraminodecalin), and combinations and mixtures thereof, and the like, including plasticized fibers thereof, energetics such as, GAP (glycidyl azide polymer), BDNPA/F (bis-2-dinitropropylacetral/formal), bis-(2-fluoro-2,2-dinitroethyl)formal, diethylene glycol dinitrate, glycerol trinitrate, glycol trinitrate, triethylene glycerol dinitrate, trimethylolethane trinitrate butanetriol trinitrate, or 1,2,4-butanetriol trinitrate, may be included. Examples of suitable energetic binder materials are nitrocellulose, polyvinyl nitrate, nitroethylene, nitroallyl acetate, nitroethyl acrylate, nitroethyl methacrylate, trinitroethyl acrylate, dinitropropyl acrylate, C-nitropolystyrene and its derivatives, polyurethanes with aliphatic C- and N-nitro groups, polyesters made from dinitrocarboxylic acids and dinitrotrodiols and nitrated polybutadienes.

For example, the extruded double base formulations are processed by the solventless method where a slurry of nitrocellulose (NC) is prepared including at least five times its mass in water. A nitrate ester, e.g., nitroglycerin (NG), is transferred to the slurry tank producing the double base paste. The transferring mechanism of the NG, for production quantities, is by water eduction. The eductor creates a fine emulsion of the nitroglycerin thus allowing absorption by the nitrocellulose fibers, producing a paste characterized as partially gelatinized fibers of nitrocellulose. During this process, other ingredients such as the stabilizer 2-nitrodiphenylamine (2-NDPA), inert plasticizers and processing aides may be included, provided however, that corrections for the water solubility of the respective ingredients are considered when targeting paste compositions. The paste is filtered and dried to the minimum moisture content of 12% (a minimum moisture value set by the industry in the United States to reduce fires attributed to roll-mill processing).

The paste is blended with its ballistic modifiers to achieve the desired burn rates for the propellant. The modified paste is processed on a series of roll mills, specifically known as the differential roll mill and the even-speed roll mill. The water-wet paste is remotely dumped and nipped by two parallel heated cylindrical rolls, with a gap setting of approximately 0.035-inch (0.889-mm). The rolls rotate in opposite directions with a speed differential, front roll to back roll, of 3:2 with the front roll rotating at approximately 15 rpm (hence the name differential roll mill). The surface of the front roll is roughened so that the paste will adhere to its surface and thus water is squeezed from the paste and to a lesser extent volatilized due to the high heat of the rolls. The sheet of material that is produced is commonly referred to as the pre-roll sheet. This pre-roll sheet is further processed on an even speed roll mill through a series of marriage passes, book-folds and long-folds with a gap setting of 0.065-inch (1.651-mm). A low plasticizer content of 41% creates a processing challenge because the relative hardness requires higher roll temperatures and an increased number of passes to assure joining of the folded sheets. Additionally, the low nitrogen content of the nitrocellulose decreases its rate of plasticization and increases the frequency of fires (see e.g., Chandler, C. D., Musser, D. A., Langford, T. H., Krajokowski, E. A., Reduction of Rolled Powder Fires, pp. 361-370, July 1991.). At this point a thermoplastic sheet is produced commonly known as sheet-stock. The sheet-stock is slit into 4-inch (10.2-cm) wide sections and rolled into what is known as carpet roll. The carpet roll can be used to extrude strands for burn-rate testing or propellant grains for motor firings.

Figure 2:
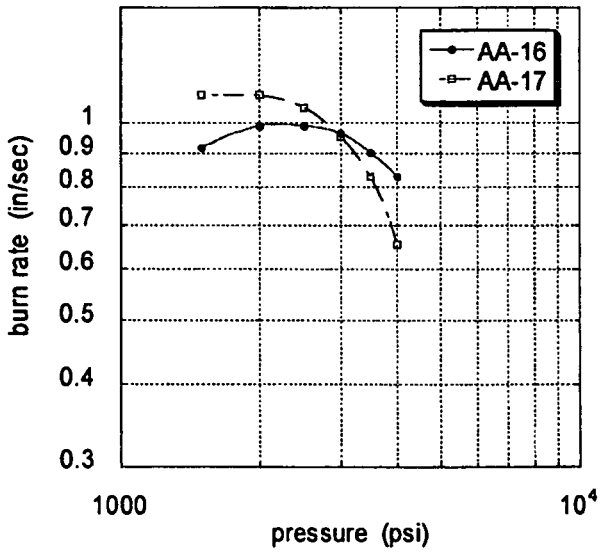
FIG. 2 illustrates a strand burn rate of two compositions incorporating the ballistic modifiers of the present invention.

In the absence of ballistic modification the propellants generally exhibit an exponential relationship of burn-rate versus pressure (shown in FIG. 1). FIG. 1 represents burn-rate data obtained from extruded strands of unmodified propellant including a paste, which, in an embodiment, includes a nominal 57% nitrocellulose, 31% nitroglycerin, 10% triacetin and 2% 2-nitrodiphenylamine. The nitrocellulose is made from cotton linter and nitrated to include 12.2% nitrogen. In contrast, FIG. 2 represents a strand burn rate of compositions AA-16 and AA-17, which incorporate ballistic modifiers of the present invention. Accordingly, the present invention provides for a higher burn rate at a lower pressure compared to the conventional technology as indicated by FIG. 1. In particular, in composition AA-16, a ballistic modifier of lead stannate/cupric oxide has been incorporated into the composition so that the composition includes a burn rate from about 0.9 in/sec. to 1 in/sec. about at a pressure range from about 1,000 psi-2,000 psi as indicated by the substantially positive sloped burn rate-pressure curve. In composition AA-17, the ballistic modifier includes lead oxide/tin oxide/cupric oxide. As seen in FIG. 2, compositions AA-16 and AA-17 demonstrate the unique plateau and mesa characteristics within the pressure range of 1500-4000 psi (10.3-27.6 MPA) for modified compositions.

In an embodiment, the extruded double base propellants that incorporate the modifier of the present invention are processed by the solventless method. In this method, a paste is produced from a water slurry of nitrocellulose and its plasticizer(s). The paste composition, referred to as exemplified compositions AA-16 and AA-17, generally includes a nitroglycerin concentration of about 31 wt %, and triacetin of about 10 wt % providing an extremely low plasticized propellant. With this composition, the paste may be considered to be a low energy paste with a heat of explosion (HOE) at 900 calories/gram. As this directly affects the burn rate, it has been surprisingly discovered that the ballistic modifiers impart distinct super-rate, plateau and mesa combustion properties.

EXPERIMENTAL (ACTUAL) RESULTS

Example 1

Double Base Paste Manufacture

Double base paste was produced on a 10-pound scale by the slurry process. Nitrocellulose may be added to a steel pot including at least five times its mass of water and mixed. The slurry may be heated to a maximum 110° F. (40° C.). 2-nitrodiphenylamine and Candelilla wax flakes may be mixed and ground for several minutes in water, using a blender fitted with a stator and rotor attachment. The mixture may be added to the nitrocellulose slurry. A separatory funnel may be fitted above the slurry pot and the nitroglycerin solvent may be added to the funnel. The solvent may be pre-formulated to contain the desired plasticizer ratio needed for the composition and stabilized with 2-NDPA. While mixing the nitrocellulose, the nitroglycerin solvent may be dripped into the slurry. Additional water may be added to the pot to reduce the slurry viscosity and prevent settling of the paste. The paste may be mixed for approximately an additional thirty minutes after all the nitroglycerin solvent had been added. The paste may be filtered through a muslin bag and squeezed to remove excess water. The paste may be placed on trays and allowed to dry at ambient conditions. Several batches of paste were prepared and blended in either a 25-gallon or 100-gallon horizontal, sigma blade mixer. Chemical analysis verified the composition. Contact process water was used to maintain the moisture level of the paste; therefore no corrections were needed to account for the water solubility of the nitroglycerin and triacetin.

A propellant composition demonstrated significant effects from the manner in which the ballistic modifiers are incorporated during the manufacture of the propellant. The amount of work applied on the even-speed roll mill provides significant effect on strand burn-rate data, detailed below in Examples 2 to 9. Processing of the propellant in a manner to ensure an even distribution of the modifier of the present invention affects the defined plateau and mesa burning rate characteristics.

Example 2

Figure 3:
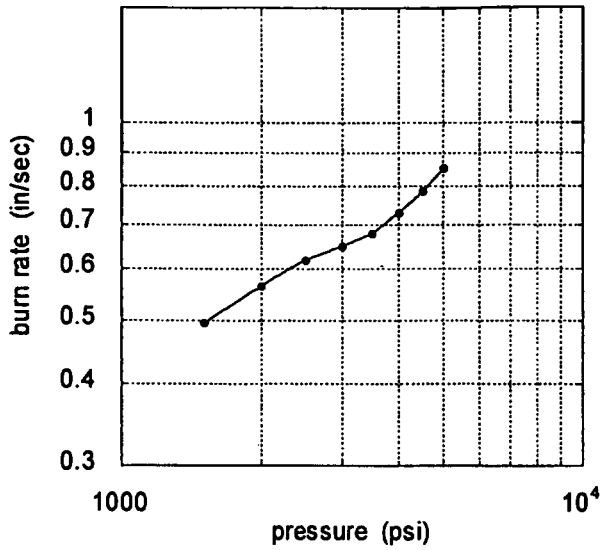
FIG. 3 illustrates a strand burn-rate for a particular propellant mix.

Commercially available materials were used and incorporated with the paste in a horizontal mixer. The lead stannate supplied may be ground slightly with a mortar and pestle and added with the cupric oxide to the propellant paste. The strand burn rate data was at 68° F., over the pressure range of 1500 psi to 5000-psi (10.3 MPa to 34.5 MPa), collected at intervals of 500-psi. As seen in FIG. 3, the propellant composition displayed very little super-rate effect and thus no plateau. Optical microscopy of a 10-micron thick section of propellant composition displayed the ballistic modifiers as large particles, up to 30-microns in diameter, and with very poor distribution around the fibers of plasticized nitrocellulose. The translucent area represents the longitudinal cross-section of the nitrocellulose fibers. The optical microscope magnified the sample 555 times and the photos taken display an offset of 45° from the orientation of the nitrocellulose fibers. The direction of the nitrocellulose fibers are oriented parallel to the direction that the propellant sheet comes off the even speed roll mill.

Example 3

Figure 4:
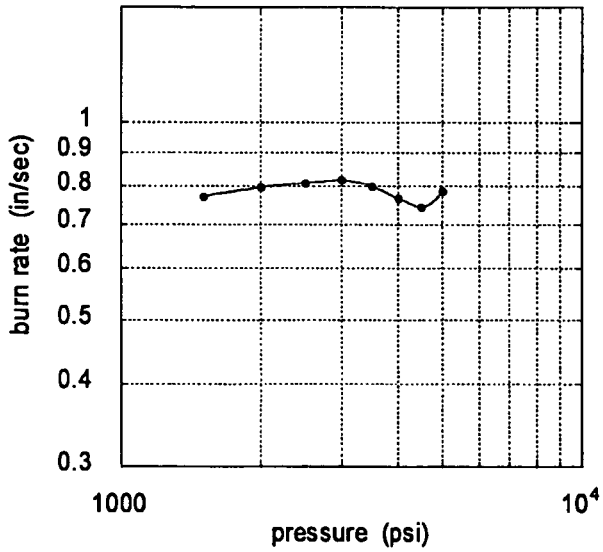
FIGS. 4 and 5 illustrate strand burn rates for two mixtures having decreased copper particle sizes.
Figure 5:
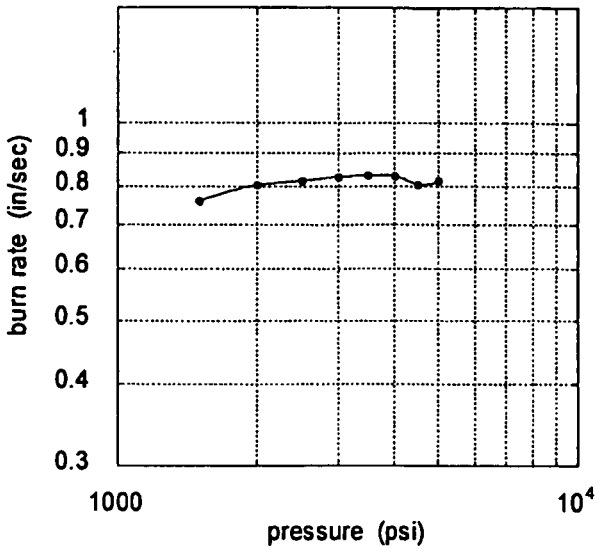

Recognizing the particle size and distribution within the propellant paste in Example 4, further processing of the lead-tin and copper components was effected. To avoid environmental and health concerns with particle size reduction in the dry state, both modifiers may be blended with a rotor-stator, in a water slurry. This homogenized slurry mix was then added to the double base paste during the mixing cycle. As seen in FIGS. 4 and 5, subsequent testing resulted in increased burning rates. Optical microscopy showed a more homogenous propellant with reduced particle size and improved distribution. In Example 2 and this Example 3, variations of opaque versus translucent areas in the propellant mixes were found. All mixes contain the same quantity of ballistic modifiers.

As seen in this Example 3, an additional factor for improving incorporation of the ballistic modifiers in the propellant was the presence of water, in a manner similar to that of a wetting agent. Generally, paste moisture prior to mixing may be up to about 35 wt %, such as, about 20 wt % to about 25 wt %, and higher after the ballistic modifiers have been added. With the high water content of the processing, it is believed that the distribution of the modifier was further perfected within the propellant.

Example 4

Generally, paste moisture prior to mixing was conducted at ranges from about 20 wt % to about 25 wt % after the ballistic modifiers have been added. Drying the paste, to achieve a 12% minimum, prior to rolling on the differential mill was a concern due to the semi-volatile properties of the plasticizers nitroglycerin and triacetin. Any drying performed was done using forced air at ambient temperatures. High moisture content of the paste adversely affected the quality of sheet produced from the differential roll mill.

Example 5

Differential Speed and Even Speed Roll Mill Processing

Remotely operated machinery of a differential roll mill was used to further gelatinize the nitrocellulose fiber and produce a sheet of propellant with thermoplastic like properties. During this process, the majority of water may be removed by squeezing the paste as it was nipped between the two opposing rolls. Various conditions of the paste and the equipment impacted the quality of the sheet. Under ideal conditions, the wet paste adheres to the rough roll while being worked on the opposing roll, which is rotating at a different speed. This step may be generally accomplished when the paste moisture is near its 12% minimum and the rough roll is regularly sandblasted. Under these conditions, paste may be processed up to three minutes and cut from the front roll. Paste with much higher moisture content did not adhere very long to the rough roll, which proved to be the case for many of the evaluation mixes with roll times lasting only 90-seconds. The material produced under these conditions was generally several pieces of sheet. This configuration made processing the material on the even-speed roll mill a greater challenge and also required the material to be worked with more passes.

By using a series of marriage passes (the joining of two or more sheets), book-folds and long-folds on the even-speed roll mill, a smooth sheet of propellant was produced. Following the marriage pass, a series of book fold passes and long fold passes were performed to achieve a specific property of the sheet. The material may be flexed through a 90° to 180° bend to inspect for the occurrence of cracks and other indications of whether a sufficient network of nitrocellulose fibers was produced.

A significant difference was found between double base paste and sheet-stock produced from the paste mix, after it had been processed through both roll mills. Longitudinal cross-section of the sheet-stock evidenced 10 micron to 100 micron segments of nitrocellulose fibers present, with the same sheet of propellant viewed from its cross-section showing fiber diameters of 20-microns. Generally, fiber lengths from cotton linter can be up to several thousand microns. The fibers displayed in the double base paste showed minimum lengths of several hundred microns.

Increased burning rates of the propellant of the present invention were found to be affected by the extent that the propellant sheetstock was reworked on the even speed roll mills. With increased processing of the propellant sheetstock, burn-rate increases were evidenced.

Example 6

Figure 6:
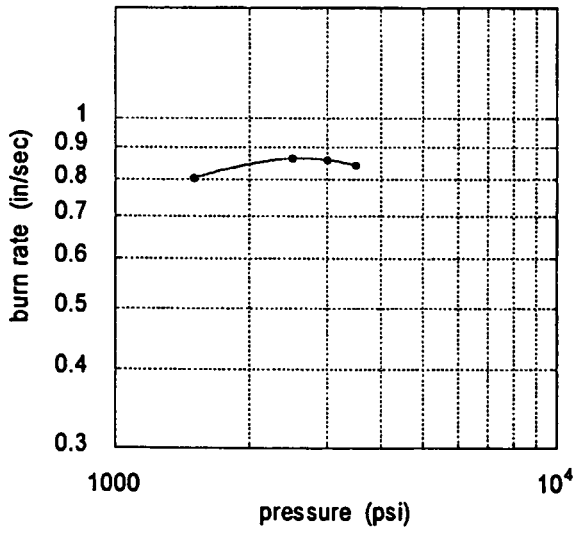
FIG. 6 shows a strand burn rate of a mix initially worked with twenty passes on a even speed roll mill.
Figure 7:
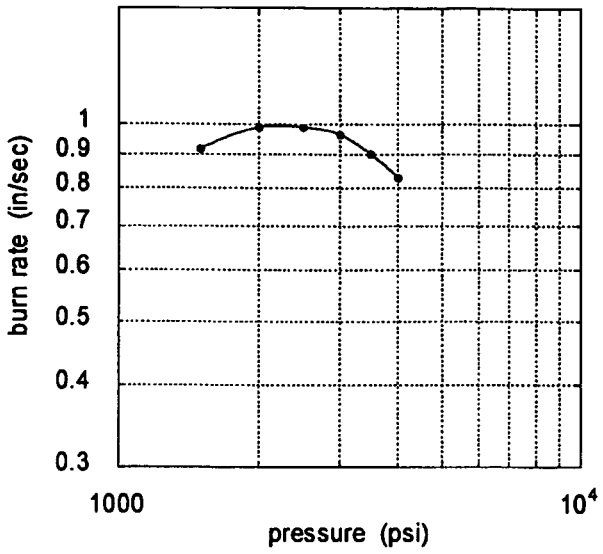
FIG. 7 shows a strand burn rate of the mix of FIG. 6 after an additional twenty passes.

As seen in FIG. 6, the strand burn rate data of an evaluation mix initially worked with twenty passes on the even speed roll mill. FIG. 7 presents data from the same evaluation mix of FIG. 6 with an additional twenty passes performed later on the same sheet of propellant. The end result was a minimum 15% increase in burn-rate within the pressure range of 1500 psi to 3000 psi (10.3 MPa to 20.7 MPa).

Evaluation of the ballistic modifiers involved a very thorough examination of the materials with respect to their chemical and physical properties. The individual effects as well as the synergism that exists were investigated. Through this process, the properties were identified that gave the necessary burn rates.

Example 7

Figure 8:
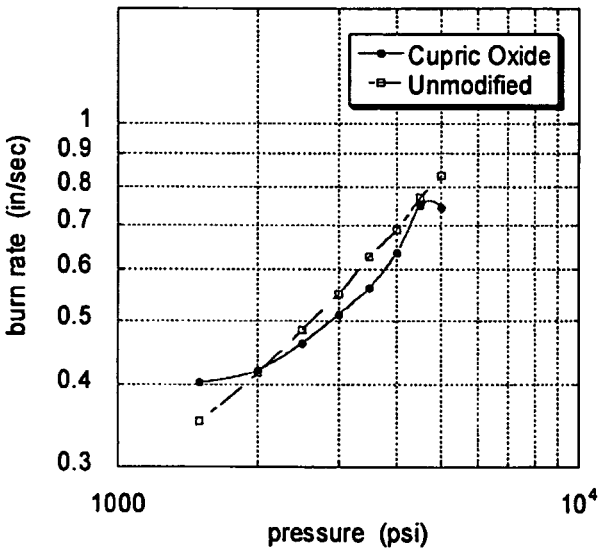
FIG. 8 shows a comparison of the addition of cupric oxide versus unmodified strand burn rate.
Figure 9:
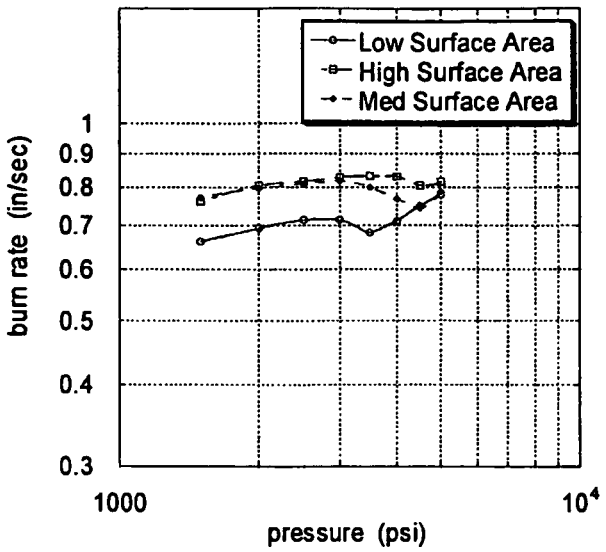
FIG. 9 shows a comparison of various cupric oxide surface areas for burn rate.

Comparison of cupric oxide versus an unmodified strand burn rate is shown in FIG. 8. As seen in FIG. 8, there is little effect of cupric oxide acting as an independent ballistic modifier compared to unmodified propellant. Evaluation mixes identified the effects of cupric oxide as a modifier, shown in FIG. 9, with respect to its surface area, with no effects observed from particle size of the cupric oxide. The effect of surface area was first observed on strand burn rate data from three evaluation mixes in which the cupric oxide was the only variable. The materials used covered the particle range of 41-nanometers to 30-microns and the surface area ranged from an 8-$m^2$/g up to 40-$m^2$/g. Surprisingly, the larger particle material has the largest surface area. As a control, the same lot of lead stannate was used for each evaluation. FIG. 9 shows a strong surface area effect.

Example 8

Figure 10:
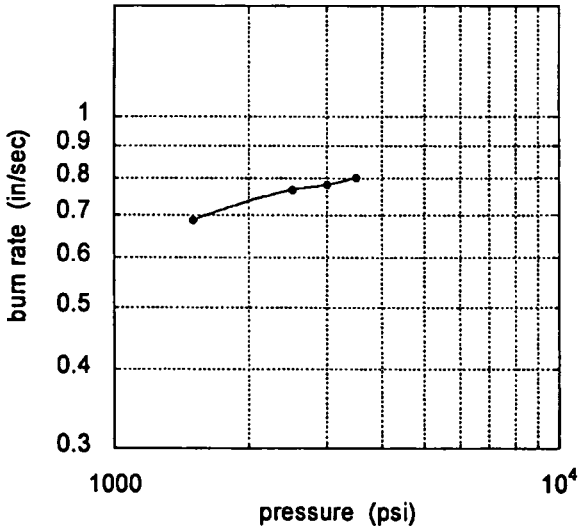
FIG. 10 shows the effects of lead stannate as an independent ballistic modifier.
Figure 11:
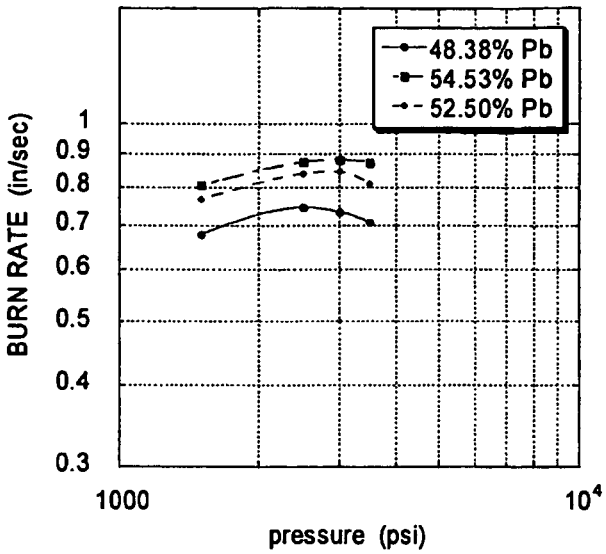
FIG. 11 shows the effects of lead content in the lead stannate as an independent ballistic modifier.

Investigation of lead modifiers, such as, lead stannate, also was conducted. Several mixes of lead stannate were prepared to determine the significance of lead stannate as an independent ballistic modifier. Various lots of lead stannate, all differing in lead content, may be used while keeping all other variables constant, i.e., the differences in the lots of lead stannate used were the lead content. FIG. 10 shows the effects of lead stannate as the independent ballistic modifier. As seen in FIG. 10, a strong plateau characteristic occurs when using lead stannate alone. Additionally, the effect of lead content in the lead stannate was observed, shown in FIG. 11, in three evaluation mixes which kept all other variables constant. It was observed that the lead content in the lead stannate is proportional to its super-rate effect on burn rate.

Example 9

Figure 12:
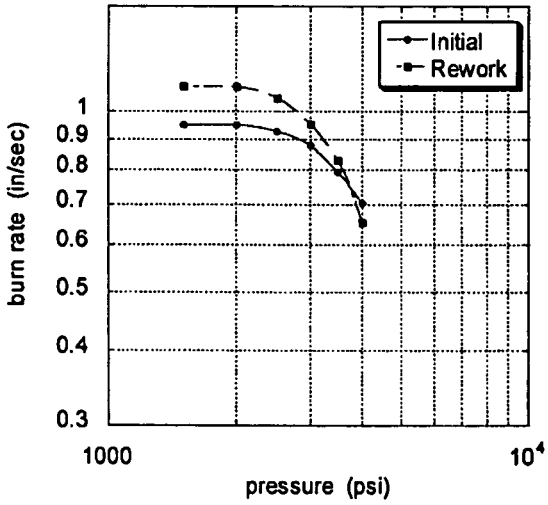
FIG. 12 shows a strand burn rate of a combination of lead oxide (PbO), tin oxide ($SnO_2$) and cupric oxide (CuO); and, FIG. 13 shows a strand burn rate comparison of lead oxide, tin oxide and cupric oxide with lead stannate and cupric oxide.
Figure 13:
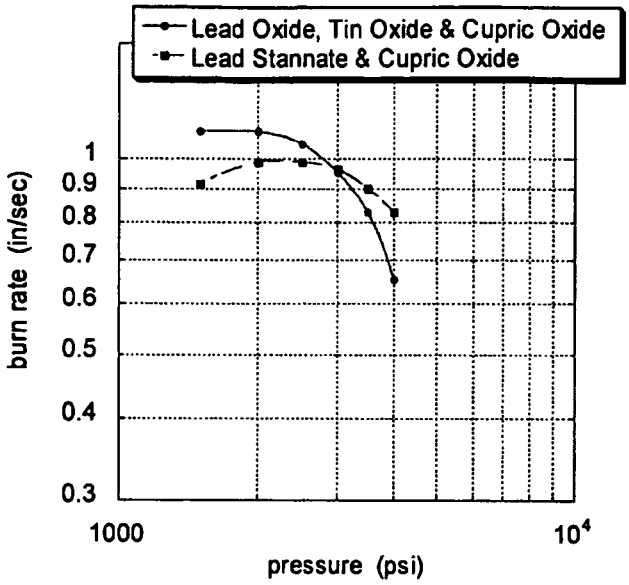

Another surprising discovery occurred when, in an attempt to understand its molecular effect, lead stannate was replaced with lead oxide (PbO) and tin oxide ($SnO_2$), in the same proportion. A premix of the lead oxide, tin oxide and cupric oxide, was prepared by homogenization with a rotor and stator. Strand burn rate was performed after the initial rolling and again after being reworked. FIG. 12 depicts this data and shows a much flatter plateau in the pressure region from 1500 psi to 2030 psi (10.3 MPa to 14 MPa) than with the use of lead stannate, shown in FIG. 13.

Representative manufacture of the modified propellant includes achieving the desired burning rate characteristics in part by using a water slurry premixing process. The three component modifiers are added, in the wet state, to wet paste during the mixing process. Modified propellant paste batches are aged up to 120 days and dried to a minimum of twelve percent moisture content. The modified paste is processed on a heated differential roll mill for approximately three minutes, after which final burning rate characteristics are achieved by additional processing on the even speed roll mill. Alternatively, processing the propellant by adding ballistic modifiers, in the dry state, to wet paste during the mixing process. The modified propellant paste batches are dried down to one percent or less moisture content. The dry paste is processed on an even speed roll mill with up to forty passes. However, this second method of processing leads to an increase in roll mill fires because of the dry state of the propellant paste and the amount of work being induced on the roll mills. Pre-processing of the ballistic modifiers provides increased control over the final burning rate characteristics.

The modifier of the present invention is particularly useful in propellants for military Propulsion Actuated Devices (PAD), ejection seats and other like devices, particularly those used in United States Navy Aircrew Escape Systems in, aircraft, such as, the F/A-18, F-14, T-45A, EA-6B and T-6A, or programs under the NACES Preplanned Product Improvement Effort and the NASA T-38 Escape System Upgrade.

The foregoing summary, description, and examples of the present invention are not intended to be limiting, but are only exemplary of the inventive features, which are defined in the claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A double base propellant modifier, comprising in combination:

a lead-tin component including a lead amount in a range of greater than 0 to less than 100 wt %; and, a copper component including a surface area value, wherein the lead-tin component is comprised of $PbSnO_2$ and $Pb_3SnO_4$.

2. The double base propellant modifier of claim 1, wherein the lead amount is from about 40 wt % to about 70 wt % of a mass of the lead-tin component.

3. The double base propellant modifier of claim 1, wherein the lead amount is from about 50 wt % to about 60 wt % of a mass of the lead-tin component.

4. The double base propellant modifier of claim 3, wherein the lead amount is from about 52 wt % to about 57 wt % of a mass of the lead-tin component.

5. The double base propellant modifier of claim 1, wherein the copper component is selected from at least one of CuO and $Cu_2O$.

6. The double base propellant modifier of claim 1, wherein the copper component is comprised of CuO.

7. The double base propellant modifier of claim 6, wherein the CuO includes said surface area value is from about 20 $m^2$/g to about 40 $m^2$/g.

8. The double base propellant modifier of claim 6, wherein the CuO includes said surface area value is from about 25 $m^2$/g to about 35 $m^2$/g.

9. The double base propellant modifier of claim 6, wherein the CuO includes said surface area value is about 30 $m^2$/g.

10. The double base propellant modifier of claim 1, wherein the lead amount is from about 52 wt % to about 57 wt % of a mass of the lead-tin component, and the surface area value is from about 25 $m^2$/g to about 35 $m^2$/g.

11. A double base propellant, comprising:

the double base propellant modifier of claim 1.

12. A method for defining burn rate characteristics of a double base propellant, comprising:

providing a double base propellant modifier including a lead-tin component and a copper component;

providing a double base propellant, wherein the double base propellant is a paste double base propellant;

drying the double base propellant to a minimum moisture content of 12%;

integrating the double base propellant modifier into the double base propellant; and, burning the double base propellant.

13. The method of claim 12, wherein the double base propellant modifier is a ballistic modifier.

14. The method of claim 12, wherein the copper component includes a particle size in a range from about 41 nanometers to about 30 microns.

15. The method of claim 12, wherein the lead-tin component includes a lead content of at least about 40%.

16. The method of claim 12, wherein the copper component includes a component purity of at least about 70%.

* * * * *